US005439115A

United States Patent [19]

Beyzavi et al.

[11] Patent Number: 5,439,115

[45] Date of Patent: Aug. 8, 1995

[54] PROCESS FOR SELECTIVE FLOTATION OF COPPER-LEAD-ZINC SULFIDE

[75] Inventors: Ali-Naghi Beyzavi, Frankfurt; Leo Kitschen, Oberursel; Friedrich Rosenstock, Frankfurt; Horst Dittmann, Büdingen, all of Germany

[73] Assignee: Metallgesellschaft Aktiengesellschaft, Frankfurth am Main, Germany

[21] Appl. No.: 149,087

[22] Filed: Nov. 9, 1993

[30] Foreign Application Priority Data

Nov. 12, 1992 [DE] Germany ..... 42 38 244.0

[51] Int. Cl.[6] ..... B03D 1/02; B03D 1/06; B03B 1/00

[52] U.S. Cl. ..... 209/167; 209/166

[58] Field of Search ..... 209/1, 166, 167, 901; 252/61

[56] References Cited

U.S. PATENT DOCUMENTS

| | | |
|---|---|---|
| 1,067,485 | 7/1913 | Nutter . |
| 1,636,974 | 7/1927 | Wiser . |
| 1,678,259 | 7/1928 | Martin . |
| 1,869,532 | 8/1932 | Weinig . |
| 1,893,517 | 1/1933 | Gaudin . |
| 1,955,978 | 4/1934 | Ruth . |
| 1,973,558 | 9/1934 | Brinker . |
| 2,048,370 | 7/1936 | Brinker . |
| 2,150,114 | 3/1939 | Anderson . |
| 2,205,194 | 6/1940 | Green . |
| 2,898,196 | 8/1959 | Forward . |
| 3,102,854 | 9/1963 | Atwood . |
| 3,655,044 | 4/1972 | Delaney . |
| 3,883,421 | 5/1975 | Cutting . |
| 4,011,072 | 3/1977 | Holman . |
| 4,283,017 | 8/1981 | Coale . |
| 4,460,459 | 7/1984 | Shaw . |
| 4,561,970 | 12/1985 | Heimala . |
| 4,585,549 | 4/1986 | Malghan . |
| 4,879,022 | 11/1989 | Clark . |
| 5,074,994 | 12/1991 | Ray . |
| 5,108,495 | 4/1992 | Heimala . |

FOREIGN PATENT DOCUMENTS

| | | |
|---|---|---|
| 499430 | 4/1979 | Australia . |
| 1238430 | 6/1988 | Canada . |
| 1243349 | 10/1988 | Canada . |
| 1150031 | 6/1963 | Germany . |
| 56-144757 | 11/1981 | Japan . |
| 21880 | of 1915 | United Kingdom . |
| 629974 | 9/1978 | U.S.S.R. . |

OTHER PUBLICATIONS

Beck, R. D. et al. "The Broken Hill Concentrator or Black Mountain Mineral Dev. Co. Ltd. South Africa". Presented at Complex Sulfide Ore Conference, Rome, Italy Oct. 8, 1980.

Wills, B. A. "The Separation by Flotation of Copper–Lead–Zinc Sulfides", Mining Magazine–Jan.–1984.

"Flotation Reagents" 1960 American Cyanamid Co.

Roberts, A. N. "Metallurgical development at Woodlawn Mines, Australia"—Presented at Complex Sulfide Ore Conf., Rome, Oct. 8, 1980.

Beyzavi, A. N. et al. "Selective Flotation of Sulfidic COmplex Ores . . . " Elsevier from *Proceedings of the XVE International Mineral Processing Congress* Amsterdam 1988.

*Primary Examiner*—Thomas M. Lithgow

*Attorney, Agent, or Firm*—Herbert Dubno; Jonathan Myers

[57] ABSTRACT

In a process for a selective flotation of a copper-lead-zinc sulfide ore the raw ore is ground and slurried with water and the resulting suspension is aerated with air to adjust a certain oxidation-reduction potential and is subsequently successively conditioned with $SO_2$, $Ca(OH)_2$, and collecting and frothing agents, whereafter a flotation of Cu is effected. An oxidation-reduction potential which is 70 to 90% of the oxidation-reduction potential desired for the flotation of Cu is adjusted by the aeration of the suspension with air before the flotation of Cu, the desired oxidation-reduction potential of 60 to 340 mV is adjusted during the flotation of Cu by the aeration with air, the flotation of Cu is effected at a pH of 8.5 to 10.5 and Cu is removed from the flotation process with the froth.

11 Claims, No Drawings

PROCESS FOR SELECTIVE FLOTATION OF COPPER-LEAD-ZINC SULFIDE

FIELD OF THE INVENTION

The present invention relates to a process for selective flotation of copper-lead-zinc sulfide ore. More particularly this invention relates to a process of the type in which the raw ore is ground and slurried with water and the resulting suspension is aerated with air to establish a certain oxidation-reduction potential and is subsequently successively conditioned with $SO_2$, $Ca(OH)_2$, and collecting and frothing agents, whereafter a flotation of Cu is effected.

BACKGROUND OF THE INVENTION

The influence of the oxygen concentration, the oxidation-reduction potential and the pH of the flotation slurry on the recovery and on the quality and selectivity of individual metals recovered from ores by flotation has often been described in the prior art.

In "*The Role of Oxygen in Sulfide Ore Flotation*", Panaiotov, V.; Semkov, N.; Arnaudov, R.; Mirchev, V. (Bulg.) Obogashch. Rud (Leningrad) 1986 (4) 16–18, (Russ), the increase of the oxygen concentration is described as having different influences on the recovery of different metals. It is also concluded that the control of the oxidation-reduction potential can be used to optimize the selective recovery of minerals from complex ores by flotation.

In "*Algorithms of the Conditioning of a Slurry of Uniform Copper-Nickel Sulfide Ores*" K. G. Bakinov, Yu V. Shtabov (USSR) Teor. Osn. Kontrol Protsessov of Flotatsli 1980, 198 to 204, (Russ), the improvement of the flotation of polymetallic sulfide ores by an optimizing of the oxidation-reduction potential is described.

In "*Evaluation of Processes occurring in the Flotation of Pulp*", S. B. Leonov, O. N. Bel'kova, Veshchestv. Sostav Obogatimost Miner. Syr'ya 1978, 74-8, (Russ), effects are described which depend, inter alia, on the oxidation-reduction potentials in the aqueous phase and in sulfide minerals in the flotation pulp and on the hydrophobizing of the sulfide ores. The selective flotation of lead sulfide, zinc sulfide, and copper sulfide is also described.

Published Soviet Patent Application SU-O 1,066,657 discloses a process in which the oxidation-reduction potential is achieved by a change of the degree of the aeration with air, namely, by a change of the rate at which air is introduced into the pulp. The time of aeration and the time in which the rate of change of the oxidation-reduction potentials are measured in minutes throughout the measured aerating time.

XVIth International Mineral Processing Congress, edited by E. Forssberg, Elsevier Science Publishers B. V., Amsterdam 1988 "*Selective Flotation of Sulfidic Complex Ores With Special Reference to the Interaction of Specific Surface, Redox Potential and Oxygen Content*" A. N. Beysavi, L. P. Kitschen, pages 565 to 578, discloses the selective flotation of copper from copper-lead-zinc ores, which are particularly rich in pyrites. It has been shown that an optimum adjustment of the oxidation-reduction potential before the first flotation stage, namely the flotation of copper, will result in a remarkable improvement of the selectivity. It is also apparent from that publication that the oxidation-reduction potential depends on the particle size of the ground ore, on the pH and on the regulators. The ore was finely ground and was then slurried in water. The resulting suspension was filtered and the filter cake was intensely washed with fresh water to remove the so-called toxic components, such as $S^{2-}$, $S_2O_3^{2-}$, $SO_3^{2-}$ and $SO_4^{2-}$.

The solids were reslurried and the slurry was first aerated with air to adjust a certain oxidation-reduction potential and was then conditioned with $SO_2$ and thereafter with CaO and finally with collecting and frothing agents.

Throughout the process the oxidation-reduction potential and the oxygen content and the pH values were measured. The oxidation-reduction potential, which was selected for the flotation of Cu, was adjusted by control of the rate at which oxygen was supplied by the aeration before the conditioning with $SO_2$.

The investigations have revealed the strong dependence of the flotation of Cu on the oxidation-reduction potential. The experiments were carried out at oxidation-reduction potentials from −260 mV to +183 mV. It has been found that, e.g., at −260 mV the froth consists almost exclusively of purities and only 1.3% of the solids in the froth consist of copper. At oxidation-reduction potentials from 171 mV to 183 mV it could be shown that galena begins to enter the froth so that 14 to 41% of the lead contained in the ore was already present in the froth.

It could also be shown that for the investigated ores there is an optimum range for the oxidation-reduction potential in which a high percentage of the copper is recovered with a high selectivity of Cu in the flotation of Cu.

That publication teaches that the recovery of copper and the selectivity of the separation of copper cannot be increased further. The other publications discussed hereinbefore also fail to suggest how the recovery and the selectivity can be improved further.

OBJECTS OF THE INVENTION

It is an object of the invention to provide for the flotation of a copper-lead-zinc sulfide ore an economical process, in which the flotation of Cu results in a maximum recovery of copper in conjunction with the highest selectivity for copper and with minimum losses of lead and zinc.

Another object is to provide an improved process for the flotation recovery of copper whereby drawbacks of earlier systems are avoided.

DESCRIPTION OF THE INVENTION

These objects are attained in accordance with the invention by setting an oxidation-reduction potential which is 70 to 90% of the oxidation-reduction potential desired for the flotation of Cu by the aeration of the suspension with air before the flotation of Cu, the desired oxidation-reduction potential of 60 to 340 mV is adjusted during the flotation of Cu by the aeration with air, the flotation of Cu is effected at a pH of 8.5 to 10.5 and Cu is removed from the flotation process with the froth.

If the optimum oxidation-reduction potential is adjusted during the aeration before the conditioning with $SO_2$, that potential will increase further during the flotation so that oxidation-reduction potentials are reached in the flotation of Cu at which other metal sulfides, such as PbS (galena) and ZnS (sphalerite) are activated and are removed together with the froth formed by the flotation of Cu and the selectivity of the copper in the flotation of Cu is thus decreased.

The flotation of Cu is that flotation stage in which the copper is recovered. In addition to a deterioration of the quality of the Cu concentrate, the poor selectivity will also result in losses of Pb and/or Zn. If 70 to 90% of the optimum oxidation-reduction potential are reached before the flotation of Cu, i.e., before the conditioning with $SO_2$, 90% of the copper pyrites ($CuFeS_2$) will already have been activated before the flotation of Cu whereas PbS and ZnS will not yet have been activated. Only during the flotation of Cu will the oxidation-reduction potential reach its optimum value at a time at which the migration of the copper from the pulp into the froth has been termination and copper has already been removed with the froth.

As a result, the copper can selectively be removed with the froth.

To adjust the oxidation-reduction potential during the aeration with air before the conditioning with $SO_2$, that percentage of oxygen is supplied which is required to achieve the optimum oxidation-reduction potential. It the oxidation-reduction potential is required to be 70 to 90% of the oxidation-reduction potential that is required for a selective flotation of copper, 70 to 90% of the amount of oxygen which is required to achieve the optimum oxidation-reduction potential will be introduced during the aeration. It has been found that it is highly desirable to add 1 g $SO_2$ per kg solids to the pulp during the succeeding addition of $SO_2$.

In one important aspect of the invention, the oxidation-reduction potential desired for the flotation of Cu is 60 to 75 mV. It has been found that in this case, in the processing of copper-lead-zinc ores which contain 0.6 to 1.4% by weight Cu, 0.6 to 1.4% by weight Pb and 2.0 to 3.0% by weight Zn the highest recovery of copper and the highest selectivity for copper will be achieved in the flotation of copper.

According to another aspect of the invention the oxidation-reduction potential desired for the flotation of Cu is 155 to 170 mV. In this case, it has been found that in the processing of copper-lead-zinc ores which contain 4 to 6% by weight Cu, 0.1 to 0.5% by weight Pb and 11.0 to 12.5% by weight Zn the highest recovery of copper and the highest selectivity for copper will be achieved in the flotation of copper.

According to yet another aspect of the invention the oxidation-reduction potential which is desired for the flotation of Cu is 325 to 340 mV. In this case in the processing of copper-lead-zinc ores which contain 0.4 to 1.5% by weight Cu, 0.01 to 0.1% by weight Pb and 0.02 to 0.15% by weight Zn the highest recovery of copper and the highest selectivity for copper will be achieved in the flotation of copper.

According to a preferred feature of the invention the oxidation-reduction potential which is adjusted by the aeration of the suspension with air before the flotation of Cu is 75 to 85% of the oxidation-reduction potential which is desired for the flotation of Cu.

Preferably, according to the invention, the flotation of Cu is effected at a pH of 9.0 to 9.7.

According to a particularly preferred feature of the invention the flotation of Cu is effected at a pH of 9.3 to 9.5.

According to a preferred feature of the invention the suspension obtained as an underflow by the flotation of Cu is adjusted with $Ca(OH)_2$ to a pH of 9.3 to 12 and together with collecting and frothing agents is used for a flotation of Pb and Pb is removed with the froth. It has desirably been found that the recovery of Pb will be particularly high and the selectivity for Pb relative to Zn will be very desirable in that pH range.

According to a particularly preferred embodiment of the invention the oxidation-reduction potential of 80 to 360 mV which is desired for the flotation of Pb is adjusted by the aeration with air during the flotation of Pb. It has desirably been found that a particularly high recovery of Pb and a particularly desirable selectivity relative to Zn will be achieved in the flotation of Pb in that range.

According to a preferred feature of the invention, the suspension obtained as an underflow by the flotation of Pb is conditioned with $CuSO_4$ and is subsequently adjusted with $Ca(OH)_2$ to a pH from 11.5 to 12.5 and together with collecting and frothing agents is used for the flotation of Zn and Zn is removed with the froth. It has been found that the underflow from the flotation of Pb is desirably adjusted to a pH in that range, in which a particularly high recovery of the Zn which was present has been observed.

According to a particularly preferred feature of the invention the oxidation-reduction potential from 110 to 450 mV which is desired for the flotation of Zn is adjusted by an aeration with air during the flotation of Zn. It has desirably been found that the recovery of zinc will be very high if the oxidation-reduction potential is within that range.

More particularly, the process of the invention can comprise the steps of:

(a) grinding a raw copper-lead-zinc sulfide ore to a flotation-separation particle size and slurrying said copper-lead-zinc sulfide ore in water to form a suspension;

(b) adjusting said suspension by aeration with air prior to flotation of copper to an oxidation-reduction potential of 70% to 90% of said optimum oxidation-reduction potential;

(c) conditioning said suspension with $SO_2$, $Ca(OH)_2$, a flotation collecting agent and a flotation frothing agent; and (d) adjusting an optimum oxidation-reduction potential for copper transfer to a flotation froth for said suspension during the flotation by the aeration with air dependent upon composition of said ore and in a range of 60 to 340 mV and adjusting a pH of 8.5 to 10.5 therein; and (e) thereafter in a flotation separation of Cu from said suspension removing said froth containing Cu.

The determination of the optimum oxidation-reduction potential for any given composition can be effected by the flotation of a sample of a suspension containing same, utilizing air as the frothing medium and for the oxidation-reduction potential at which, with continuous inspection of the froth at regular intervals, microscopic examination shows that the copper content of the froth, which can be continuously removed during the flotation of the copper, has become negligible.

SPECIFIC EXAMPLES

The invention will be explained with reference to examples:

EXAMPLES:

The experiments were carried out with the ores described hereinafter, which contained Cu, Pb and Zn as stated in the table.

| | Type of ore | Cu Wt. % | Pb Wt. % | Zn Wt. % | $E_{opt}$[1] mV |
|---|---|---|---|---|---|
| Portugese ore | I | 0.85 | 0.85 | 2.37 | 68 |
| Turkish ore (Cayeli) | II | 5.00 | 0.21 | 11.7 | 164 |
| Turkish ore (Küre) | III | 0.97 | 0.05 | 0.07 | 327 |

Control example[2]

| Type of ore | $E_1$[6] mV | Removal[3] % | Content[4] Cu | Content[4] Pb | Content[4] Zn | Recovery[5] Cu | Recovery[5] Pb | Recovery[5] Zn |
|---|---|---|---|---|---|---|---|---|
| I | 68 | 5.7 | 12.1 | 0.80 | 1.50 | 80.2 | 5.4 | 3.6 |

Example 1

1 kg ore (type I) was ground in a wet mill to a particulate size of $d_{80}=18$ micrometers and was charged into a flotation cell (2 liters). Sufficient water was added to form a suspension containing 500 g solids per liter. At a rate of 2 liters per minute, air was then introduced into the flotation cell until an oxidation-reduction potential of 55 mV was obtained.

When an oxidation-reduction potential of 55 mV had been achieved, the introduction of air was discontinued. Thereafter 20 ml of an aqueous solution containing 5% by weight $SO_2$ were charged into the flotation cell and were permitted to act for 5 minutes. To adjust the suspension to the desired pH 9.5, the requisite amount of milk of lime (a suspension of 10 g CaO in 90 ml $H_2O$) was added and was permitted to act for 2 minutes.

A mixture of 40 mg Na-isopropyl xanthate and 40 mg Hostaflot TM 1923 as a collecting agent was then charged into the flotation cell and was permitted to act for 5 minutes. Thereafter, 20 mg Flotol TM B as a frothing agent was charged into the flotation cell and was permitted to act for 1 minute.

Thereafter, air at a rate of 2 liters per minute was introduced into the flotation cell. The froth formed by the flotation was continually inspected in that samples of the newly formed froth were taken at regular intervals of time and were subjected to microscopic examination. The flotation was continued until the microscopic examination revealed that the removal of copper in the newly formed froth had become very slight. Thereafter the flotation was discontinued. The optimum oxidation-reduction potential of 68 mV which was desired for the flotation of Cu was measured at the end of the flotation. The quantity of the solids removed in the froth formed by the flotation amounted to 50 g. The test results are apparent from the following table

| Type of ore | $E_1$[6] mV | $E_2$[7] mV | Removal[3] g | Content[4] Cu | Content[4] Pb | Content[4] Zn | Recovery[5] Cu | Recovery[5] Pb | Recovery[5] Zn |
|---|---|---|---|---|---|---|---|---|---|
| I | 55 | 68 | 50 | 13.9 | 0.75 | 1.35 | 81.3 | 4.4 | 2.9 |

Example 2

This example was carried out like Example 1 with the difference that before the addition of $SO_2$, air was introduced into the flotation cell until an oxidation-reduction potential of 142 mV had been adjusted and that the optimum oxidation-reductor potential of 164 mV was measured at the end of the flotation.

| Type of ore | $E_1$[6] mV | $E_2$[7] mV | Removal[3] g | Content[4] Cu | Content[4] Pb | Content[4] Zn | Recovery[5] Cu | Recovery[5] Pb | Recovery[5] Zn |
|---|---|---|---|---|---|---|---|---|---|
| II | 142 | 164 | 52 | 23 | 0.3 | 3.8 | 88.0 | 30.0 | 6.9 |

Example 3

This example was carried out like Example 1 with the difference that before the addition of $SO_2$, air was introduced into the flotation cell until an oxidation-reduction potential of 262 mV had been adjusted and that the optimum oxidation-reduction potential of 327 mV was measured at the end of the flotation.

| Type of ore | $E_1$[6] mV | $E_2$[7] mV | Removal[3] g | Content[4] Cu | Content[4] Pb | Content[4] Zn | Recovery[5] Cu | Recovery[5] Pb | Recovery[5] Zn |
|---|---|---|---|---|---|---|---|---|---|
| III | 262 | 327 | 54 | 9.5 | 0.05 | 0.22 | 81.0 | 8.3 | 26.0 |

NOTES:

1) Optimum oxidation-reduction potential

2) The control example has been taken from the publication of A. N. Beysavi and L. P. Kitschen discussed as prior art.

3) Removal in the control example is the percentage of the charged ore which was removed with the froth formed by the flotation and in Examples 1 to 3 the removal is the weight of solids removed.

4) Content indicates in the control example the distribution in the solids removed in percent and in Examples 1 to 3 content indicates the percentages by weight of Cu, Pb, and Zn in the solids removed.

5) In the control example the amounts of Cu, Pb, and Zn which were removed are stated in percent of the amounts originally contained in the ore. In Examples 1 to 3 the recovery indicates the amounts in which Cu, Pb, and Zn originally contained in the ore.

6) Oxidation-reduction potential adjusted by the aeration with air before the introduction of $SO_2$. (In the control example =optimum oxidation-reduction potential).

7) Oxidation-reduction potential measured during the flotation of Cu (in Examples 1 to 3=optimum oxidation-reduction potential).

We claim:

1. A process for selective flotation of a copper-lead-zinc sulfide ore, comprising the steps of:

(a) grinding a raw copper-lead-zinc sulfide ore to a flotation-separation particle size and slurrying said copper-lead-zinc sulfide ore in water to form a suspension;

(b) adjusting said suspension by a first aeration with air prior to flotation of copper to an oxidation-reduction potential of 70% to 90% of its optimum oxidation-reduction potential and then discontinuing said first aeration;

(c) conditioning said suspension without aeration, adjusted during step (b), with $SO_2$, $Ca(OH)_2$, a flotation collecting agent and a flotation frothing agent;

(d) adjusting said oxidation-reduction potential of said suspension to its optimum for copper transfer to a flotation froth for said suspension, adjusted according to step (b) and conditioned according to step (c), during the flotation by a second aeration with air dependent upon composition of said ore and in a range of 60 to 340 mV and adjusting a pH of 8.5 to 10.5 therein; and (e) thereafter in a flotation separation of Cu from said suspension, adjusted according to step (b), conditioned according to step (c), and adjusted according to step (d), removing said froth containing Cu.

2. The process defined in claim 1 wherein said optimum oxidation-reduction potential according to step (d) is 60 to 75 mV.

3. The process defined in claim 1 wherein said optimum oxidation-reduction potential according to step (d) is 155 to 170 mV.

4. The process defined in claim 1 wherein said optimum oxidation-reduction potential according to step (d) is 325 to 340 mV.

5. The process defined in claim 1 wherein the suspension is aerated in step (b) to an oxidation-reduction potential of 75% to 80% of said optimum oxidation-reduction potential.

6. The process defined in claim 1 wherein the pH adjusted in step (d) and at which flotation separation of Cu is carried out in step (e) is 9.0 to 9.7.

7. The process defined in claim 6 wherein the pH adjusted in step (d) and at which flotation separation of Cu is carried out in step (e) is 9.3 to 9.5.

8. The process defined in claim 1 further comprising the steps of:

(f) obtaining an underflow from the flotation separation in step (e);

(g) adjusting said underflow with $Ca(OH)_2$ to a pH of 9.3 to 12;

(h) effecting a flotation separation of Pb from said underflow in the presence of a collecting agent and a frothing agent; and (i) removing Pb with a froth produced in the flotation separation of Pb.

9. The process defined in claim 8 wherein an oxidation-reduction potential of 80 to 360 mV is adjusted in the underflow suspension by aeration with air during flotation separation of Pb.

10. The process defined in claim 8 further comprising the steps of:

(k) obtaining an underflow from the flotation separation in step (i);

(l) conditioning said underflow with $CuSO_4$;

(m) adjusting said underflow with $Ca(OH)_2$ to a pH of 11.5 to 12.5;

(n) effecting a flotation separation of Zn in the presence of a collecting agent and a frothing agent; and (o) removing Zn with a froth produced in the flotation separation of Zn.

11. The process defined in claim 10 wherein an oxidation-reduction potential of 110 to 450 mV is adjusted in the underflow suspension subjected to the flotation separation of Zn by aeration with air.

* * * * *